US006511929B1

(12) United States Patent
Vogt et al.

(10) Patent No.: US 6,511,929 B1
(45) **Date of Patent: *Jan. 28, 2003**

(54) METHOD OF IMPROVING WASHFASTNESS OF METALLIZED FABRIC

(75) Inventors: Kirkland W. Vogt, Simpsonville, SC (US); Tina Louise Kanipe, Pacolet Mills, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/493,638

(22) Filed: Jan. 28, 2000

Related U.S. Application Data

(62) Division of application No. 09/148,182, filed on Sep. 4, 1998, now Pat. No. 6,242,369.

(51) Int. Cl.[7] ..... D03D 15/00; B05D 1/36

(52) U.S. Cl. ..... 442/228; 427/250; 427/265; 427/288; 427/404; 427/383.1; 427/389.9; 442/148; 442/152; 442/153; 442/164; 442/228

(58) Field of Search ..... 427/250, 265, 427/288, 404, 412, 383.1, 389.9; 442/148, 152, 153, 164, 228

(56) References Cited

U.S. PATENT DOCUMENTS 6,191,056 B1 * 2/2001 Vogt et al. ..... 442/148

* cited by examiner

*Primary Examiner*—Terrel Morris
*Assistant Examiner*—John J. Guarriello
(74) *Attorney, Agent, or Firm*—Terry T. Moyer; William S. Parks

(57) ABSTRACT

This invention relates to metallized, particularly aluminized, fabrics which are coated with specific polyurethane finishes. Such specific polyurethanes must be cross-linked and present in latex form. Upon impregnation within metal-coated fabrics, these particular polyurethanes provide vastly improved washfastness properties to the fabrics and thus ensure the retention of substantially all the metal coating within and on the target fabric.

6 Claims, No Drawings

METHOD OF IMPROVING WASHFASTNESS OF METALLIZED FABRIC

CROSS REFERENCE TO RELATED APPLICATIONS

This application is a divisional of application Ser. No. 09/148,182, now U.S. Pat. No. 6,242,369 filed on Sep. 4, 1998. This parent application is herein entirely incorporated by reference.

FIELD OF THE INVENTION

This invention relates to metallized, particularly aluminized, fabrics which are coated with specific polyurethane finishes. Such specific polyurethanes must be cross-linked and present in latex form. Upon impregnation within metal-coated fabrics, these particular polyurethanes provide vastly improved washfastness properties to the fabrics and thus ensure the retention of substantially all the metal coating within and on the target fabric.

DISCUSSION OF THE PRIOR ART

Metallized fabrics have recently been utilized in order to provide effective heat insulation for garments, particularly apparel for use outdoors and in cold-weather climates. Other uses for such fabrics have included incorporation within radar-detectable objects, such as in U.S. Pat. No. 4,390,588, to Ebneth et al.; water-repellent automobile covers, as in U.S. Pat. No. 5,271,998, to Duckett et al.; strength-enhanced fibrous materials, as in U.S. Pat. No. 3,660,138, to Gorrell. Washfastness is a very important characteristic which needs to be exhibited by metallized fabrics, particularly those which are intended to be incorporated within garments. Generally, such metal coatings, in particular aluminum, easily washes out of and from fabric substrates upon standard laundering procedures. Past attempts have been made to reduce the loss of metal from such fabrics. These include U.S. Pat. No. 5,744,405, to Okumura et al., which requires a siloxane over coat adhered to the metal-coated fabric through a plasma pre-treatment; and U.K. Patent 800,093, to Kunsch, which discloses the pre-treatment of fabric with cross-linked polyurethanes and the like, prior to depositing metal on the treated fabric surface. The Kunsch pre-treatment basically acts as an adhesive for the metal to remain bonded to the fabric substrate. These methods have proven to be either costly (with the high expense of plasma pre-treatments and particular siloxanes), or ineffective (with the mere utilization of an adhesive to bind the metal to the fabric leaving an appreciable amount of metal susceptible to removal through inadvertent contact and friction with certain surfaces as well as corrosion through atmospheric and aqueous oxidation). As such, there is no teaching or fair suggestion within the prior art which pertains to the improvement in metal-coated fabric washfastness provided by cross-linked polyurethane/acrylic polymer which is impregnated within the target fabric after deposition of the metal composition.

DESCRIPTION OF THE INVENTION

It is thus an object of the invention to provide improved washfastness for metallized fabrics. A further object of the invention is to manufacture a polyurethane-coated, aluminized fabric with better washfastness than comparable aluminized fabric. Another object of the invention is to provide a metallized fabric for incorporation within garments for the outdoor and cold-weather climate apparel industries which provides effective and appreciable levels of heat insulation throughout the wearable lives of such garments. Yet another object of this invention is to provide a fabric for use in any type of heat insulation covering or fabric and not necessarily within apparel. Still a further object of the invention is to provide a method for producing such a metallized, washfast, heat insulation fabric.

Accordingly, this invention encompasses a fabric comprising a metal coating wherein said metal coating comprises discrete metal particles which are encapsulated within a cross-linked polyurethane latex. Nowhere within the prior art has such a specific encapsulated metal coating for fabrics been utilized to impede corrosion of the metal particles adhered to the fabric surface thereby substantially eliminating the removal of such metal particles from the fabric substrate due to atmospheric conditions and/or harsh laundering conditions.

Any fabric can be utilized in this invention as the important requirement is that the polyurethane latex thoroughly coat the metal particulate coating of the fabric in such a way as to substantially prevent contact between the metal and atmospheric oxygen or harsh oxidizing (and thus corrosive) chemicals present within laundry applications. Polyester is most preferred; however, any natural fibers, such as cotton, ramie, and the like; any synthetic fibers, such as polyamides, lycra, and the like; and any blends thereof of any natural and/or synthetic fibers may be utilized within the inventive fabric. Furthermore, woven fabrics are preferred; however, knitted and non-woven forms may also be utilized as well as combinations of any types of these forms. The important limitation of this invention is the presence of the polyurethane latex over the metal coating of the target fabric to provide a barrier to corrosive elements and thus ultimately provide a long-lasting fabric for the retention of heat.

Any metal generally utilized within a coating for fabrics may be utilized within this invention, also. The most common metal for this purpose, aluminum, is most preferred, basically because of its low cost in combination with its superior performance (particularly in provided heat retention for clothing in cold climates). Other metals which may be utilized include copper, silver, nickel, zinc, titanium, vanadium, and the like.

The preferred polyurethane component is a waterborne aliphatic or aromatic polymer which also lends a soft hand to the target fabric. As such, the preferred polyurethane is a dispersion comprising a polyurethane having an elongation of at least 150% and conversely a tensile strength at most 7,000 psi. Particular examples of such dispersions include those within the Witcobond® polyurethane series, from Witco, such as W-232, W-234, W-160, W-213, W-236, W-252, W-290H, W-293, W-320, and W-506; most preferred is W-293. Acrylic polyurethane dispersions may also be utilized provided they exhibit the same required degree of elongation and tensile strength as for the purely polyurethane dispersions.

Any cross-linking agent compatible with polyurethanes may be utilized within this invention, particularly those which have low amounts of free formaldehyde. Preferred as cross-linking agents are Cytec™ M3 and Aerotex™ PFK, both available from BFGoodrich. Any catalyst, which is generally necessary to initiate and effectuate cross-linking of a polyurethane dispersion, which is compatible with both a polyurethane and a polyurethane cross-linking agent maybe utilized within this invention. Preferred as a cross-linking catalyst is Cytec™ MX, available from BFGoodrich.

The cross-linked polyurethane latex of the invention may be present in any amount and concentration within an aqueous solution for use on and within the target fabric. The table below indicates the difference in performance of the cross-linked polyurethane latex in reference to its concentration and dry solids addition rate on the fabric surface. Preferably, the concentration of the polyurethane is from 5 to 100% by weight of the utilized aqueous solution; more preferably from 10 to about 75% by weight; and most preferably from 25 to about 50% by weight. The coating addition rate (measured as the percent of dry solids addition on the weight of the fabric) of the cross-linked polyurethane dispersion is preferably from 3 to 50% owf; more preferably from about 6 to about 40% owf; and most preferably from about 15 to about 30% owf.

As noted below, the basic procedure followed in applying this cross-linked polyurethane dispersion entails first providing a metal-coated fabric. Next, the latex is formed by combining the polyurethane with the cross-linking agent and optionally a catalyst to effectuate such cross-linking of the polyurethane. The resultant latex is then diluted with water to the desired concentration which will provide the most beneficial washfastness of the metal coating after treatment. The metal-coated fabric is then saturated with the resultant aqueous solution of the polyurethane latex with the excess being removed. Such saturation and removal of the latex may be performed in any standard manner, including dipping, padding, immersion, and the like for initial contacting of the dispersion; and wringing, drying, padding, and the like for the removal of the excess. The treated fabric is then dried and cured for a period of time, preferably at a temperature sufficient to effectuate a complete covering of the metal particles previously adhered to the target fabric surface. For example only, a temperature between about 300 and 450° F.; preferably between 310 and 400° F.; more preferably from 325 and 385° F.; and most preferably between 350 and 370° F. are workable. Times of from 2 to 30 minutes are preferred for this drying and curing step with a time between about 2 and 10 minutes most preferred.

Any other standard textile additives, such as dyes, sizing compounds, and softening agents may also be incorporated within or introduced onto the surface of the finished wrinkled apparel fabric substrate. Particularly desired as optional finishes to the inventive fabrics are soil release agents which improve the wettability and washability of the fabric. Preferred soil release agents include those which provide hydrophilicity to the surface of polyester. With such a modified surface, again, the fabric imparts improved comfort to a wearer by wicking moisture. The preferred soil release agents contemplated within this invention may be found in U.S. Pat. Nos. 3,377,249; 3,540,835; 3,563,795; 3,574,620; 3,598,641; 3,620,826; 3,632,420; 3,649,165; 3,650,801; 3,652,212; 3,660,010; 3,676,052; 3,690,942; 3,897,206; 3,981,807; 3,625,754; 4,014,857; 4,073,993; 4,090,844; 4,131,550; 4,164,392; 4,168,954; 4,207,071; 4,290,765; 4,068,035; 4,427,557; and 4,937,277. These patents are accordingly incorporated herein by reference.

This metal-coated fabric may be incorporated into a garment due to the advantages of its first retaining a substantial amount of metal particles within and on the target fabric after a long duration of wear and standard laundering; and second, retaining a substantial amount of heat due to the presence of a large amount of heat-retaining metal particles within and on the target fabric. Further uses for such a fabric include, without limitation: tents, awnings, blankets, crowd covers, jackets, scarves, and the like.

DESCRIPTION OF THE PREFERRED EMBODIMENT

The following example is indicative of the preferred embodiment of this invention:

EXAMPLE

A 100% polyester, 4×1 sateen woven fabric (115/34 warp-drawn warp yarn and 150/50 textured fill yarn, having a fabric weight of 3.5 ounces per square yard) was evaporation-coated with 0.24% (wt.) of aluminum produced by Diversified Fabrics Inc. A latex mixture of 100 grams Witcobond® W-293 (polyurethane dispersion available from Witco), 1 gram of Cytec™ M3 (cross-linking agent available from BFGoodrich), and 1 gram of Cytec™ MX (catalyst available from BFGoodrich) were then blended together in a beaker. This mixture was then diluted with water to varying concentrations as set forth in the table below. Different swatches of the aluminum-coated fabric were then saturated with these various polyurethane latex mixtures and squeezed between two wringers in order to remove excess latex. In such a procedure the polyurethane latex actually encapsulates the individual or cohered aluminum particles. Each swatch was then dried and cured at 3600° F. for about 5 minutes. Each treated swatch was then washed according to AATCC Test Method 130-1995, "Soil Release: Oily Stain Release Method" and measured for aluminum retention after different numbers of washes. The washfastness of the latex encapsulate remaining aluminum was calculated through the utilization of a % ash test according to AATCC Test Method 78-1989, "Ash Content of Bleached Cellulosic Textiles." The results were tabulated as follows:

TABLE

| Latex Conc. | Coating Addition Rate | Washfastness (% Al remaining after X washes) | | |
|---|---|---|---|---|
| (wt %) | (% Dry Solids owf) | X = 3 | X = 10 | X = 20 |
| 0 | 0 | 2.3 | 4.5 | 4.5 |
| 2.5 | 1.7 | 22.7 | 11.4 | 6.8 |
| 5.0 | 3.3 | 31.8 | 27.3 | 27.3 |
| 10.0 | 6.0 | 65.9 | 43.2 | 40.9 |
| 15.0 | 8.3 | 68.2 | 59.1 | 45.5 |
| 25.0 | 15.0 | 88.6 | 75.0 | 75.0 |
| 50.0 | 26.7 | 90.9 | 86.4 | 86.4 |
| 75.0 | 36.0 | 86.4 | 77.3 | 72.7 |
| 100 | 49.0 | 86.4 | 84.1 | 84.1 |

As is clearly evident, the washfastness of the aluminum improved dramatically first upon utilization of the cross-linked polyurethane encapsulate, and second, upon utilization of greater concentrations of the latex up to a 50% by weight concentration of the cross-linked latex in aqueous solution.

There are, of course, many alternative embodiments and modifications of the present invention which are intended to be included within the spirit and scope of the following claims.

What we claim is:

1. A method for improving the washfastness of a metal coating on a metallized fabric comprising the steps of (a) providing a fabric, at least a portion of which is coated with metal particles; and (b) subsequently coating at least a portion of said metal particle-coated portion of said fabric with a cross-linked polyurethane latex comprising a polyurethane dispersion;

a cross-linking agent; and optionally, a catalyst to initiate the cross-linking of said polyurethane dispersion.

2. The method of claim 1 wherein said polyurethane latex comprises a polyurethane dispersion having an elongation of at least 150%.

3. The method of claim 1 wherein said metal particles comprise aluminum particles.

4. A garment comprising the fabric produced by the method of claim 1.

5. A garment comprising the fabric produced by the method of claim 2.

6. A garment comprising the fabric produced by the method of claim 3.

* * * * *